US007341462B2

(12) United States Patent
Matsuoka et al.

(10) Patent No.: US 7,341,462 B2
(45) Date of Patent: Mar. 11, 2008

(54) CONNECTOR TERMINAL FABRICATION PROCESS AND CONNECTOR TERMINAL

(75) Inventors: Katsumasa Matsuoka, Aichi-ken (JP); Yoshiaki Kato, Aichi-ken (JP); Harehide Sasaki, Aichi-ken (JP)

(73) Assignee: Kabushiki Kaisha Tokai-Rika-Denki-Seisakusho, Aichi-ken (JP)

( * ) Notice: Subject to any disclaimer, the term of this patent is extended or adjusted under 35 U.S.C. 154(b) by 58 days.

(21) Appl. No.: 11/334,740

(22) Filed: Jan. 19, 2006

(65) Prior Publication Data

US 2006/0172624 A1 Aug. 3, 2006

(30) Foreign Application Priority Data

Jan. 20, 2005 (JP) ..... 2005-013348

(51) Int. Cl.
*H01R 12/00* (2006.01)

(52) U.S. Cl. ..... 439/79; 439/886; 439/931

(58) Field of Classification Search ..... 439/79, 439/886, 887, 885, 83, 931
See application file for complete search history.

(56) References Cited

U.S. PATENT DOCUMENTS 2,726,376 A * 12/1955 Heath ..... 439/742
4,662,702 A * 5/1987 Furuya ..... 439/630
4,870,227 A * 9/1989 Saen et al. ..... 174/117 FF
5,145,383 A * 9/1992 Bowen et al. ..... 439/78
5,145,413 A * 9/1992 Okamoto et al. ..... 439/620.14
5,175,928 A * 1/1993 Grabbe ..... 29/884
5,980,337 A * 11/1999 Little ..... 439/857
2004/0116004 A1* 6/2004 Kojima ..... 439/886

FOREIGN PATENT DOCUMENTS

JP 2001-110491 4/2001

* cited by examiner

*Primary Examiner*—Hien Vu
(74) *Attorney, Agent, or Firm*—Roberts, Mlotkowski & Hobbes; Thomas W. Cole

(57) ABSTRACT

An upper tier terminal is provided with a fitting portion and a board attachment portion. When the upper tier terminal is being fabricated, a first wire member which is a component of the fitting portion and a second wire member which is a component of the board attachment portion, whole peripheral surfaces of which have been subjected to a plating treatment beforehand, are employed. End portions of the first wire member and the second wire member are mutually superposed, and the first wire member and the second wire member are joined. Thus, the fitting portion is formed and the board attachment portion is formed. Hence, a surface of the upper tier terminal is structured by a plating layer at the peripheral surface of the first wire member and a plating layer at the peripheral surface of the second wire member. Consequently, a post-plating treatment can be rendered unnecessary.

10 Claims, 6 Drawing Sheets

CONNECTOR TERMINAL FABRICATION PROCESS AND CONNECTOR TERMINAL

CROSS-REFERENCE TO RELATED APPLICATION

This application claims priority under 35 USC 119 from Japanese Patent Application No. 2005-13348, the disclosure of which is incorporated by reference herein.

BACKGROUND OF THE INVENTION

1. Field of the Invention

The present invention relates to a process for fabrication of a connector terminal which is to be connected to a substrate by soldering, and to the connector terminal.

2. Description of the Related Art

On a substrate of, for example, an electronic device or electronic circuit, for example, a surface-mounted connector ("SMT connector") is mounted by soldering.

Such a connector is provided with a connector housing, which is formed in, for example, a substantially rectangular box shape, and a plurality of connector terminals (terminals), which are inserted into assembly holes formed at a side of the connector housing to be mounted. For this structure, the plurality of connector terminals are respectively subjected to a plating treatment, are respectively inflected downward (toward the substrate), and distal end portions thereof are fixed to an upper face of the substrate by soldering (see, for example, Japanese Patent Application Laid-Open (JP-A) No. 2001-110491).

Now, a plurality of connection terminals as described above is fabricated by being punched from a plate material. When this plurality of connector terminals is to be fabricated, first, a plate material (a strip member) which has not been plating-processed is punched by a pressing process to form workpieces which are linked in a comb shape (a concatenated form). After this pressing process (i.e., after punching of the plate material), whole peripheral surfaces of the workpieces (both plate material surface portions and punch-cut surface portions) still have not been plating-processed. Thereafter, the whole peripheral surfaces (both the plate material surface portions and the punch-cut surface portions) are subjected to plating by a "post-plating treatment". After that, if the plating is tin-plating, a special treatment is applied in order to suppress the formation of whiskers. The workpieces which have been processed as described hereabove are subjected to bending processing in accordance with the connector that is to be surface-mounted, and are employed as connector terminals.

Thus, according to a conventional fabrication process, plating can be reliably applied over whole peripheral surfaces of connector terminals.

However, in a conventional fabrication process as described above, a plating layer is formed at the whole peripheral surfaces of the workpieces by the "post-plating treatment", the workpieces being in the complex shape linked in a comb form and being after the pressing process (i.e., after punching of the plate material). Consequently, a film thickness of the plating layer varies between regions of post-plating, and it is difficult to make the film thickness of the plating layer uniform overall. When the film thickness of the plating layer is uneven, then, for example, insertion/extraction forces between the connector terminals and female terminals which correspond with the connector terminals are increased, which is not preferable in regard to an operation of fitting these connectors with the female connectors corresponding to the connectors.

Further, this post-plating treatment is problematic in that processing costs are much higher than with a pre-plating treatment. Accordingly, fabrication of connector terminals by punching workpieces from a plate material which has been subjected to a pre-plating treatment has been considered. However, cut surface portions thereof are, naturally, in an unplated state and, if a plating layer at those portions is necessary (for example, when such cut surface portions are regions which are to be soldered), the post-plating treatment cannot be omitted. Therefore, the problem of treatment costs being incurred due to performance of the post-plating treatment is fundamentally insoluble, and measures for suppressing costs of plating processing, and hence fabrication costs of connector terminals, have been sought.

Further still, when the workpieces are subjected to a tin-plating treatment as the post-plating treatment, it is necessary to apply the special treatment for suppressing the formation of whiskers to the plating layer. Consequently, there is a problem in that processing costs are further raised.

SUMMARY OF THE INVENTION

In consideration of the problems described above, the present invention will provide a connector terminal fabrication process and a connector terminal, which can suppress fabrication costs in comparison with a case in which a post-plating treatment is applied.

A connector terminal fabrication process of a first aspect of the present invention is a process for fabrication of a connector terminal to be assembled to a connector housing which is mounted on a substrate, the connector terminal including a fitting portion which fits with a connection terminal of a corresponding connector (a connector which is to be connected to this connector) and a substrate attachment portion which is connected to the substrate, the connector terminal fabrication process comprising: superposing respective end portions of a first wire member and a second wire member with one another and joining the end portions, the whole peripheral surfaces of each of the first wire member and the second wire member having been subjected to a plating treatment beforehand; and forming the fitting portion from the first wire member, and forming the substrate attachment portion from the second wire member.

In the connector terminal fabrication process of the first aspect of the present invention, the respective end portions of the first wire member and the second wire member, the whole peripheral surfaces of which have been respectively subjected to the plating treatment beforehand, are superposed with one another and are joined by being subjected to processing such as, for example, a welding process or the like.

Then, for example, the second wire member is subjected to bending processing, the fitting portion of the connector terminal is formed from the first wire member, and the substrate attachment portion of the connector terminal is formed from the second wire member.

A surface of the connector terminal which has been fabricated in this manner is constituted by a plating layer at the peripheral surface of the first wire member and a plating layer at the peripheral surface of the second wire member. Therefore, a post-plating treatment can be rendered unnecessary.

Consequently, the connector terminal fabrication process of the first aspect of the present invention can suppress plating treatment costs, and hence connector terminal fabrication costs, in comparison with a case in which a post-plating treatment is applied.

Further, in this connector terminal fabrication process, operations of, for example, applying a pressing process to a plate-form strip member and forming workpieces in a complex shape linked in a comb form subsequent to the pressing process (i.e., after punching of the plate material) are not necessary, and it is possible to fabricate the connector terminal by the simple process of joining the two wire members. Consequently, in comparison with a case of forming workpieces in a complex shape, material yield is improved.

Further still, the plating layer of the connector terminal which is fabricated by this connector terminal fabrication process is structured by the plating layers which have been formed at the whole peripheral surfaces of the first wire member and the second wire member beforehand. Therefore, irregularities in plating thickness are smaller. As a result, connector terminals with higher product quality can be fabricated.

In a connector terminal fabrication process of a second aspect of the present invention includes, in the first aspect of the present invention, a thickness of the second wire member is finer than a thickness of the first wire member.

According to the connector terminal fabrication process of the second aspect of the present invention, because a thickness of the second wire member is smaller than the thickness of the first wire member, a thickness of the substrate attachment portion of the connector terminal will be smaller than a thickness of the fitting portion.

Such connector terminals are assembled to, for example, two-tiers in a direction perpendicular to a substrate, at a side of a connector housing which is mounted to the substrate. In such a case, the connector terminals are assembled to the connector housing such that the fitting portions formed from the first wire member and substrate attachment portions formed from the second wire member neighbor and are jointed one another in planes which are parallel to the surface of the substrate. Moreover, the connector terminals of the respective tiers are assembled to the connector housing such that relative positions of the fitting portions and substrate attachment portions along the direction of neighboring are opposite between the connector terminals of one of the tiers (for example, an upper tier) and the connector terminals of the other tier (for example, a lower tier).

Here, because the thicknesses of the substrate attachment portions are smaller than the thicknesses of the fitting portions as described above, it is possible to attach the substrate attachment portions to the substrate without the substrate attachment portions of the connector terminals of the one tier and the substrate attachment portions of the connector terminals of the other tier interfering with one another.

A connector terminal of a third aspect of the present invention is a connector terminal to be assembled to a connector housing which is mounted on a substrate, the connector terminal comprising: a fitting portion which fits with a connection terminal of a corresponding connector (a connector which is to be connected to this connector); and a substrate attachment portion which is connected to the substrate, wherein the fitting portion is formed from a first wire member, a whole peripheral surface of which has been subjected to a plating treatment beforehand, and the substrate attachment portion is formed from a second wire member, a whole peripheral surface of which has been subjected to a plating treatment beforehand, an end portion of the second wire member having been superposed with and joined to an end portion of the first wire member.

According to the connector terminal of the third aspect of the present invention, the connector terminal is assembled to the connector housing, which is mounted on the substrate, for use. The connector terminal is provided with the fitting portion and the substrate attachment portion. The fitting portion fits with a connection terminal of a correspondent connector, and the substrate attachment portion is connected to the substrate.

When such a connector terminal is being fabricated, the first wire member, the whole peripheral surface of which has been subjected to the plating treatment beforehand, and the second wire member, the whole peripheral surface of which has been subjected to the plating treatment beforehand, are employed. The end portion of the first wire member and the end portion of the second wire member are mutually superposed and subjected to processing such as, for example, a welding process or the like to be joined. Thus, the fitting portion is formed from the first wire member and the substrate attachment portion is formed from the second wire member.

A surface of the connector terminal which has been fabricated in this manner is constituted by a plating layer at the peripheral surface of the first wire member and a plating layer at the peripheral surface of the second wire member. Therefore, a post-plating treatment need not be necessary.

Consequently, the connector terminal of the third aspect of the present invention can suppress plating treatment costs, and hence connector terminal fabrication costs, in comparison with a case in which a post-plating treatment is applied.

Further, when this connector terminal is being fabricated, operations of, for example, applying a pressing process to a plate-form strip member and forming workpieces in a complex shape linked in a comb form subsequent to the pressing process (i.e., after punching of the plate material) are not necessary, and it is possible to fabricate the connector terminal by the simple process of joining the two wire members. Consequently, in comparison with a case of forming workpieces in a complex shape, material yield is improved.

Further still, the plating layer of this connector terminal is structured by the plating layers which have been formed at the whole peripheral surfaces of the first wire member and the second wire member beforehand. Therefore, irregularities in plating thickness are smaller. As a result, with this connector terminal, product quality can be improved.

In a connector terminal of a fourth aspect of the present invention in the third aspect of the present invention, a thickness of the substrate attachment portion is finer than a thickness of the fitting portion.

In the connector terminal of the fourth aspect of the present invention, for example, a thickness of the second wire member is finer than a thickness of the first wire member. Consequently, the thickness of the substrate attachment portion of the connector terminal is smaller than the thickness of the fitting portion.

Such connector terminals are assembled to, for example, two tiers in a direction perpendicular to the substrate, at a side of a connector housing which is mounted to the substrate. In such a case, the connector terminals are assembled to the connector housing such that the fitting portions formed from the first wire members and substrate attachment portions formed from the second wire members neighbor and jointed one another in planes which are parallel to the surface of the substrate. Moreover, the connector terminals of the respective tiers are assembled to the connector housing such that relative positions of the fitting portions and substrate attachment portions along the direction of neighboring are opposite between the connector terminals of one of the tiers (for example, an upper tier) and the connector terminals of the other tier (for example, a lower tier).

Here, because the thicknesses of the substrate attachment portions are smaller than the thicknesses of the fitting portions as described above, it is possible to attach the substrate attachment portions to the substrate without the substrate attachment portions of the connector terminals of the one tier and the substrate attachment portions of the other tier interfering with one another.

Further, in the aspects of the connector terminal fabrication process and the connector terminal, it is possible that an attachment hole is formed in the connector housing, and the connector terminal including the fitting portion and the substrate attachment portion is engaged to the attachment hole.

Further, in the aspects of the connector terminal fabrication process and the connector terminal, it is possible that a jointed portion of the fitting portion and the substrate attachment portion is engaged to the attachment hole.

Further, in the aspects of the connector terminal fabrication process and the connector terminal, it is possible that plural connector terminals are assembled to an upper tier and a lower tier in a direction perpendicular to the substrate, at the connector housing, and relative jointed position of the fitting portion and the substrate attachment portion of the connector terminal assembled to the upper tier and relative jointed position of the fitting portion and the substrate attachment portion of the connector terminal assembled to the lower tier corresponding to the upper tier, are opposite.

Further, in the aspects of the connector terminal fabrication process and the connector terminal, it is possible that the respective end portions of the first wire member and the second wire member are superposed with one another, and a superposed portion of the first wire member and the second wire member are wrapped by a fastening member to joint the respective end portions of the first wire member and the second wire member.

The connector terminal fabrication process and connector terminal as described above can suppress fabrication costs in comparison with a case in which a post-plating treatment is applied.

BRIEF DESCRIPTION OF THE DRAWINGS

Embodiments of the invention will be described in detail with reference to the following figures, wherein.

DETAILED DESCRIPTION OF THE INVENTION

Upper tier terminals 22 and lower tier terminals 28, which serve as connector terminals which are employed at a surface-mounted connector (also referred to as an SMT connector hereafter) 10 relating to an embodiment of the present invention, will be described on the basis of FIGS. 1 to 6. Herein, for convenience of explanation, a direction indicated by arrow A in FIGS. 1 to 6 is referred to as forward, a direction indicated by arrow B, which intersects with arrow A, is referred to as rightward, and a direction indicated by arrow C, which intersects with both arrow A and arrow B, is referred to as upward.

Figure 1:
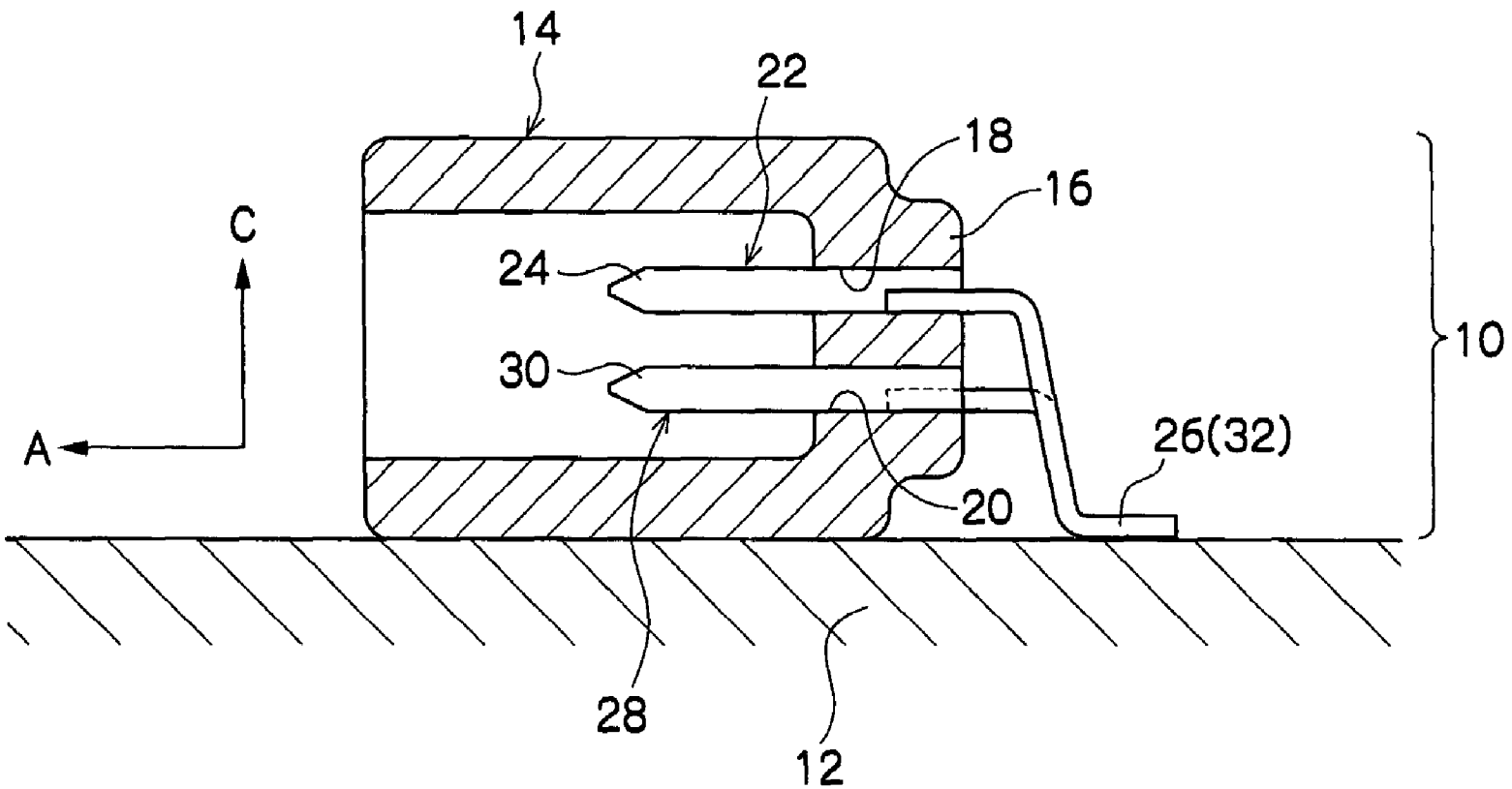
FIG. 1 is a side sectional view showing a state in which a surface-mounted connector relating to an embodiment of the present invention is mounted on a substrate (a substrate).

FIG. 1 shows a side sectional view of general structure of the SMT connector 10 and a substrate (a circuit board or the like) 12, at which the SMT connector 10 is mounted (for example, a printed substrate at which lands are printed by screen printing or the like).

Figure 2:
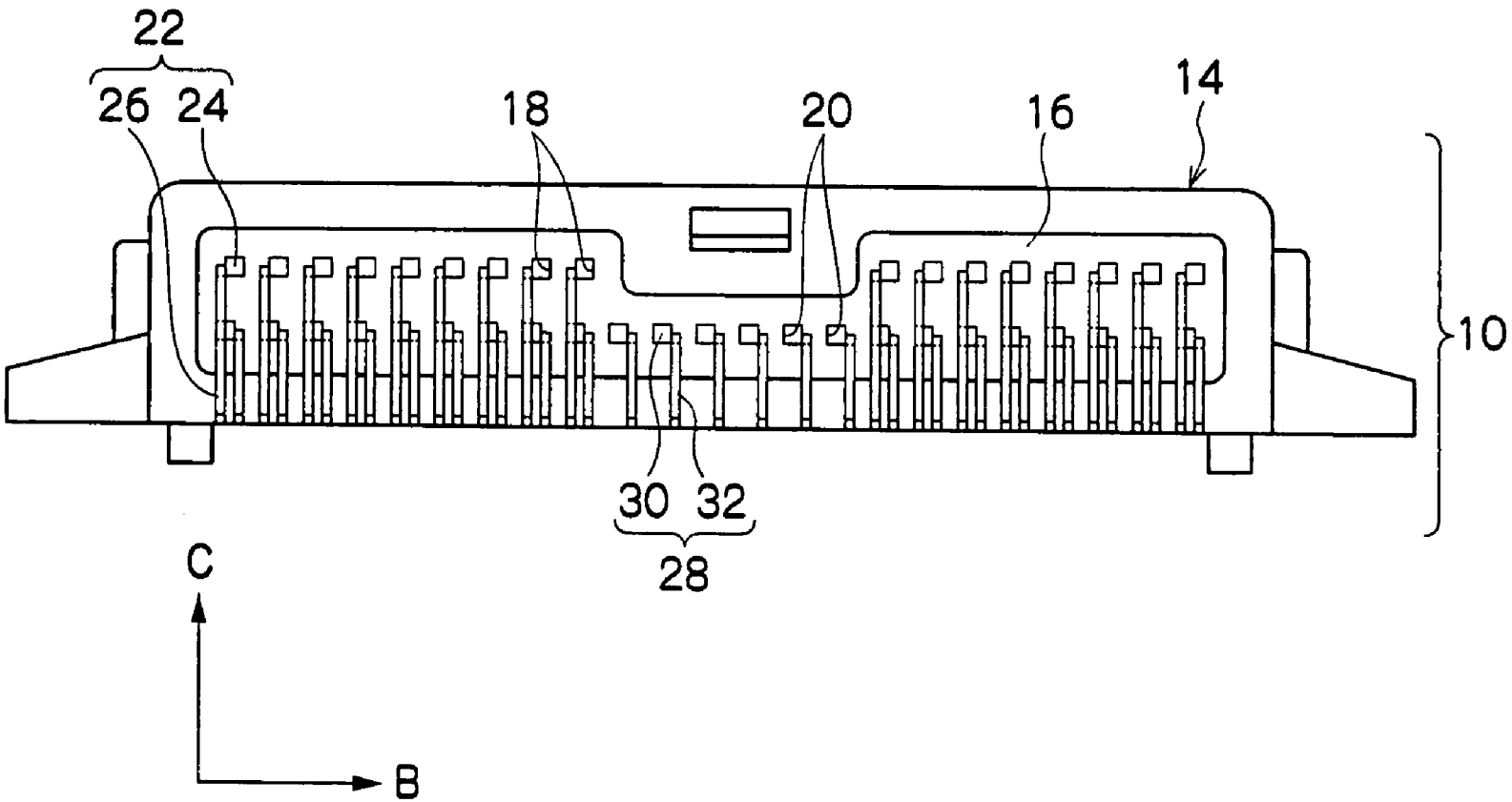
FIG. 2 is a rear view of the surface-mounted connector.

The SMT connector 10 is provided with a connector main body 14, which serves as a connector housing. The connector main body 14 is formed in, for example, a substantially rectangular box shape, and includes a rear wall 16 which stands upright from the substrate 12 when the SMT connector 10 has been mounted on the substrate 12. A plurality of upper tier terminal attachment holes 18, which are arranged in a line along the left-right direction, and a plurality of lower tier terminal attachment holes 20, which are arranged in a line along the left-right direction, are formed in the rear wall 16 (see FIG. 2). As shown in FIGS. 1 and 2, the upper tier terminal attachment holes 18 are formed directly above the corresponding lower tier terminal attachment holes 20 (except at a left-right direction central portion of the rear wall 16). The upper tier terminal attachment holes 18 are formed in shapes that correspond with the upper tier terminals 22, and the lower tier terminal attachment holes 20 are formed in shapes that correspond with the lower tier terminals 28 (see FIG. 2).

The SMT connector 10 is also provided with the plurality of upper tier terminals 22, which are arranged in a line along the left-right direction, and the plurality of lower tier terminals 28, which are arranged in a line along the left-right direction. As shown in FIGS. 1 and 2, the lower tier terminals 22 are disposed directly above (in vertical directions perpendicular to the substrate 12) the corresponding lower tier terminals 28 (apart from at the left-right direction central portion of the rear wall 16).

Figure 3:
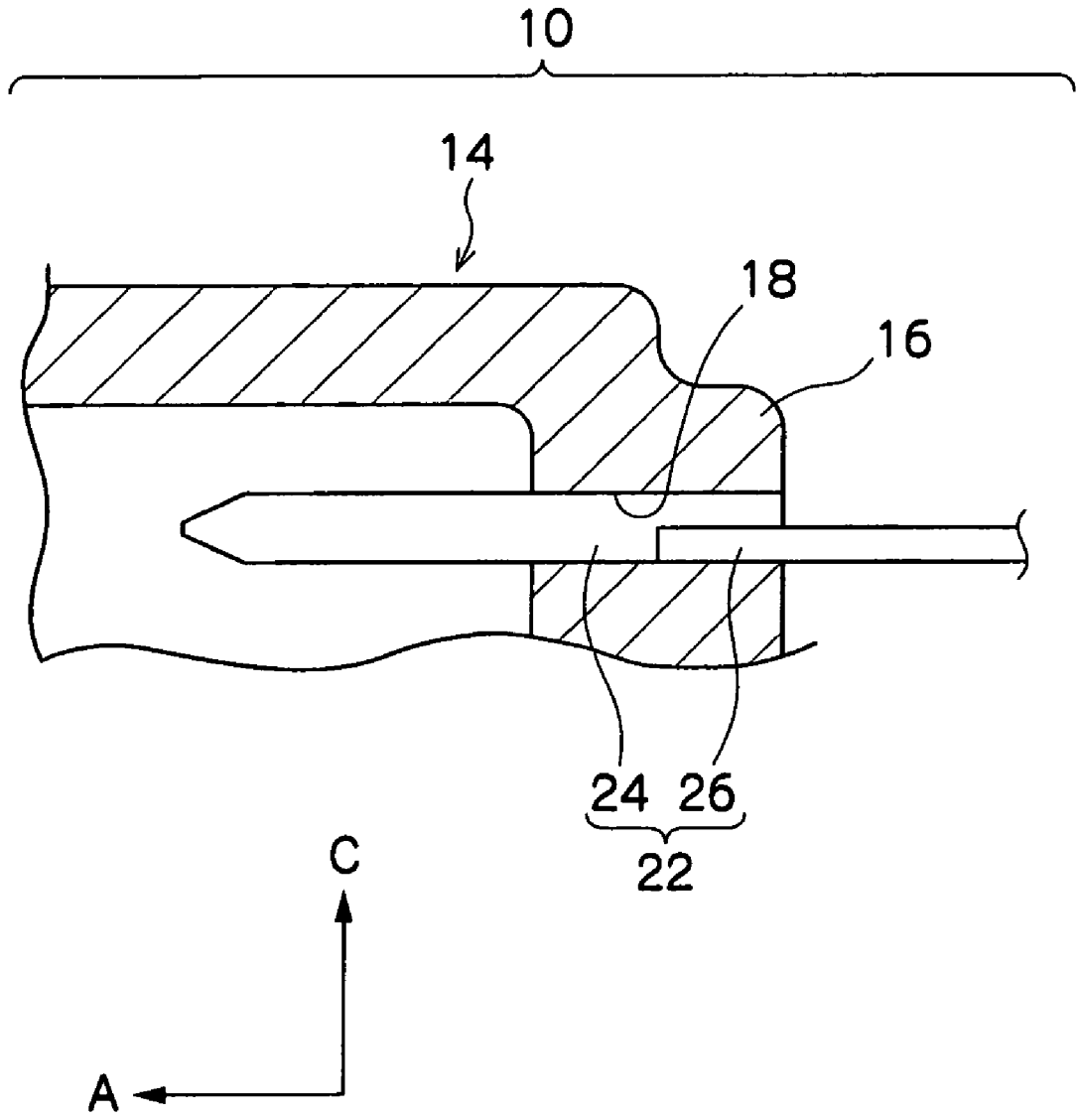
FIG. 3 is a magnified view in which a vicinity of a fitting portion of a connector terminal in the side sectional view of FIG. 1 is enlarged.

Each upper tier terminal 22 is provided with a fitting portion 24 which is engaged at the upper tier terminal attachment hole 18 formed in the rear wall 16 of the connector main body 14 (see FIGS. 1 to 3). The fitting portion 24 is formed from a first wire member 24A, a cross-section of which has a quadrilateral form (for example, a square form) and a whole peripheral surface of which has been subjected to a plating treatment (for example, a tin-plating treatment) beforehand (for example, a 0.50 plated wire member; see FIGS. 4 and 5). A proximal end portion of the fitting portion 24 is assembled to the upper tier terminal attachment hole 18.

A substrate attachment portion 26 is closely fitted to or pressed against the left side of the above-described fitting portion 24 and is joined thereto (see FIGS. 1 to 3). The substrate attachment portion 26 is formed from a second wire member 26A, a cross-section of which has a quadrilateral form (for example, a square form) and a whole peripheral surface of which has been subjected to a plating treatment (for example, a tin-plating treatment) beforehand (for example, a 0.30 plated wire member; see FIGS. 4 and 5). The second wire member 26A is formed as a wire member which is finer (with thickness t2) than a thickness t1 of the first wire member 24A, which is a component of the fitting portion 24. A proximal end portion (fitting portion 24 side end portion) of this substrate attachment portion 26 is superposed with the left side of a proximal end portion of the fitting portion 24 in a plane which is parallel with a surface of the substrate 12, and in this state is joined (that is, the substrate attachment portion 26 is offset to the left side relative to the fitting portion 24). The substrate attachment portion 26 and the fitting portion 24 together are engaged with the upper tier terminal attachment hole 18 and mounted thereat. Further, the substrate attachment portion 26 is inflected downward (toward the substrate 12) partway therealong.

A distal end portion of the substrate attachment portion 26 (an end portion thereof at a side opposite from the fitting portion 24 side thereof) is formed to be inflected so as to lie along the upper face of the substrate 12. The distal end portion of the substrate attachment portion 26 is fixed to the substrate 12 (mounted onto the substrate 12) by soldering (see FIG. 1, but note that a solder fillet provided on the substrate 12 in correspondence with the distal end portion of the substrate attachment portion 26 is omitted from the drawing).

Each lower tier terminal 28 is provided with a fitting portion 30 which is engaged at the lower tier terminal attachment hole 20 formed in the rear wall 16 of the connector main body 14 (see FIGS. 1 to 3). The fitting portion 30 is formed from the first wire member 24A, the same as the wire member which is the component of the aforementioned fitting portion 24 of the upper tier terminal 22, which is a wire member whose whole peripheral surface has been subjected to the plating treatment beforehand. A proximal end portion of the fitting portion 24 is assembled to the above-mentioned lower tier terminal attachment hole 20.

The substrate attachment portion 32 is closely fitted to or pressed against the right side of the above-mentioned fitting portion 30 and is joined thereto (see FIGS. 1 and 2). The substrate attachment portion 32 is formed from the second wire member 26A, the same as the wire member which is the component of the aforementioned substrate attachment portion 26 of the upper tier terminal 22, which is a wire member whose whole peripheral surface has been subjected to the plating treatment beforehand. Therefore, the second wire member 26A is formed as a wire member which is finer (with thickness t2) than a thickness t1 of the first wire member 24A which is a component of the fitting portion 30. A proximal end portion (fitting portion 30 side end portion) of this substrate attachment portion 32 is superposed with the right side of a proximal end portion of the fitting portion 30 in a plane which is parallel with the surface of the substrate 12, and in this state is joined (that is, the substrate attachment portion 32 is offset to the right side relative to the fitting portion 30). The substrate attachment portion 32 and the fitting portion 30 together are engaged with the lower tier terminal attachment hole 20 and mounted thereat. Further, the substrate attachment portion 32 is inflected downward (toward the substrate 12) partway therealong.

A distal end portion of the substrate attachment portion 32 (an end portion thereof at a side opposite from the fitting portion 30 side thereof) is formed to be inflected so as to lie along the upper face of the substrate 12. The distal end portion of the substrate attachment portion 32 is fixed to the substrate 12 (mounted onto the substrate 12) by soldering (see FIG. 1, but note that a solder fillet provided on the substrate 12 in correspondence with the distal end portion of the substrate attachment portion 32 is omitted from the drawing).

In the state in which these substrate attachment portions 26 and substrate attachment portions 32 have been mounted onto the substrate 12, the substrate attachment portions 26 and substrate attachment portions 32 are alternatingly spaced (that is, not interfering with one another) in the left-right direction (i.e., along the direction of arrow B) and arranged in a straight line (see FIG. 2). Thus, even though the upper tier terminal 22 and lower tier terminal 28 are assembled to the respective upper and lower tiers of the connector main body 14 at the same (matching) position in the left-right direction, the substrate attachment portions 26 of the upper tier terminals 22 and the substrate attachment portions 32 of the lower tier terminals 28 are attached to the substrate 12 in the straight line along the left-right direction without interfering.

The upper tier terminals 22 and lower tier terminals 28 described above respectively pass through the rear wall 16, protrude to rearward of the connector main body 14 and are attached to the substrate 12. Hence, the SMT connector 10 serves as a male connector, and can be connected to a female connector (corresponding connector) which is an external terminal. In this connected state, the fitting portions 24 and fitting portions 30 of the upper tier terminals 22 and lower tier terminals 28, which are male terminals, are respectively fitted to fitting portions of female terminals (corresponding terminals) which are provided at the external terminal, and are connected in conductive states therewith.

Next, operations of the embodiment of the present invention will be described.

Herebelow, for convenience of explanation, the upper tier terminal 22 will be taken as an example and a fabrication sequence thereof will be described.

Figure 4:
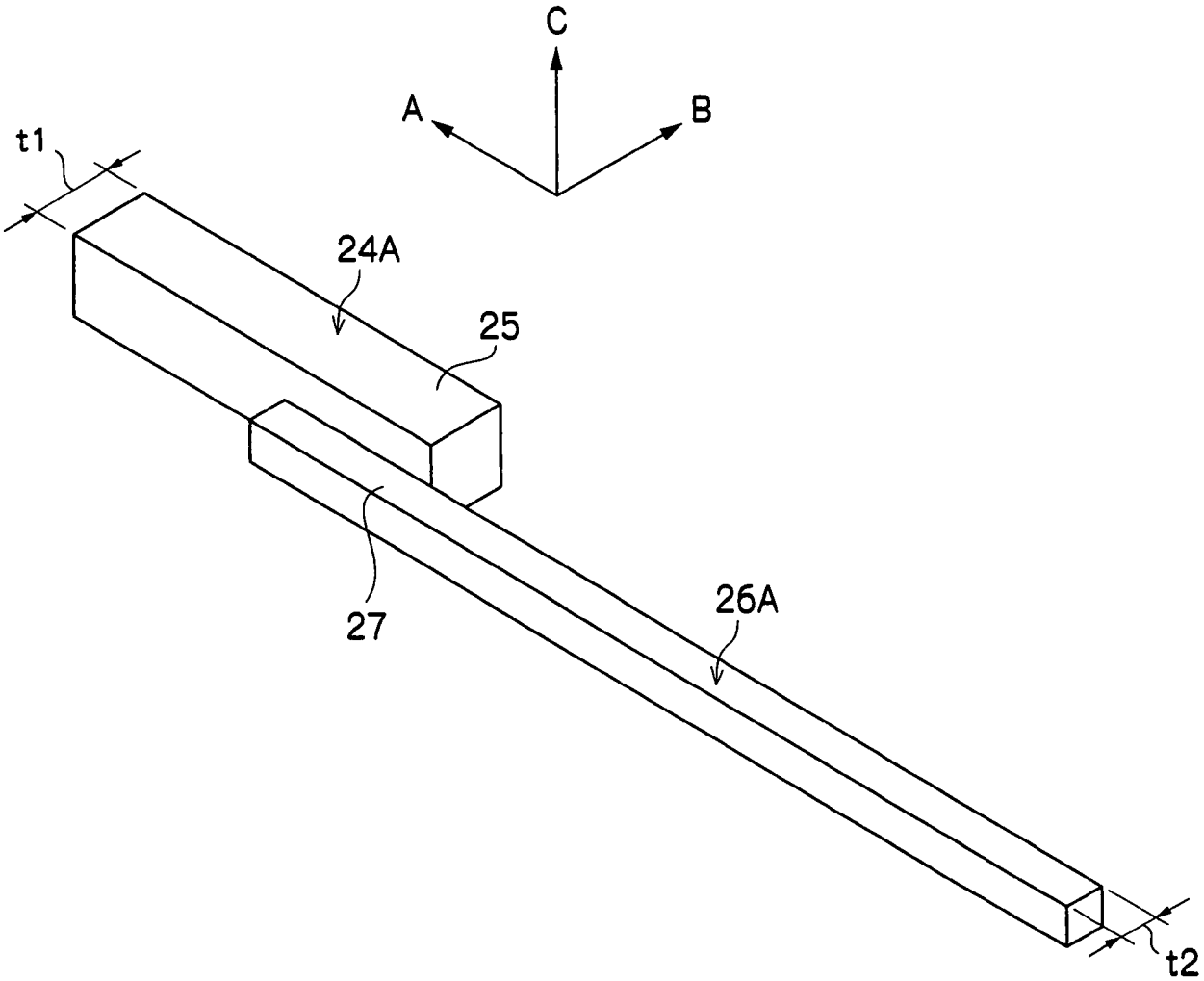
FIG. 4 is a perspective view of a step in fabrication of the connector terminal, which shows a state in which a proximal end portion of a first wire member and a proximal end portion of a second wire member are superposed.

First, as shown in FIG. 4, respective end portions of the first wire member 24A and the second wire member 26A (a proximal end portion 25 of the first wire member 24A and a proximal end portion 27 of the second wire member 26A) whose whole peripheral surfaces have been subjected to the plating treatment beforehand are superposed with one another (that is, closely fitted or pressed together) and aligned. In the present case, the first wire member 24A and the second wire member 26A are arranged next to one another such that a floor face of the first wire member 24A (i.e., in FIG. 4, of a pair of faces which are opposite from one another in the direction of arrow C, the face that is disposed at the side of a base end portion of the arrow C), and a floor face of the second wire member 26A (i.e., in FIG. 4, of a pair of faces which are opposite from one another in the direction of arrow C, the face that is disposed at the base end portion side of the arrow C) are disposed in the same plane.

Figure 5:
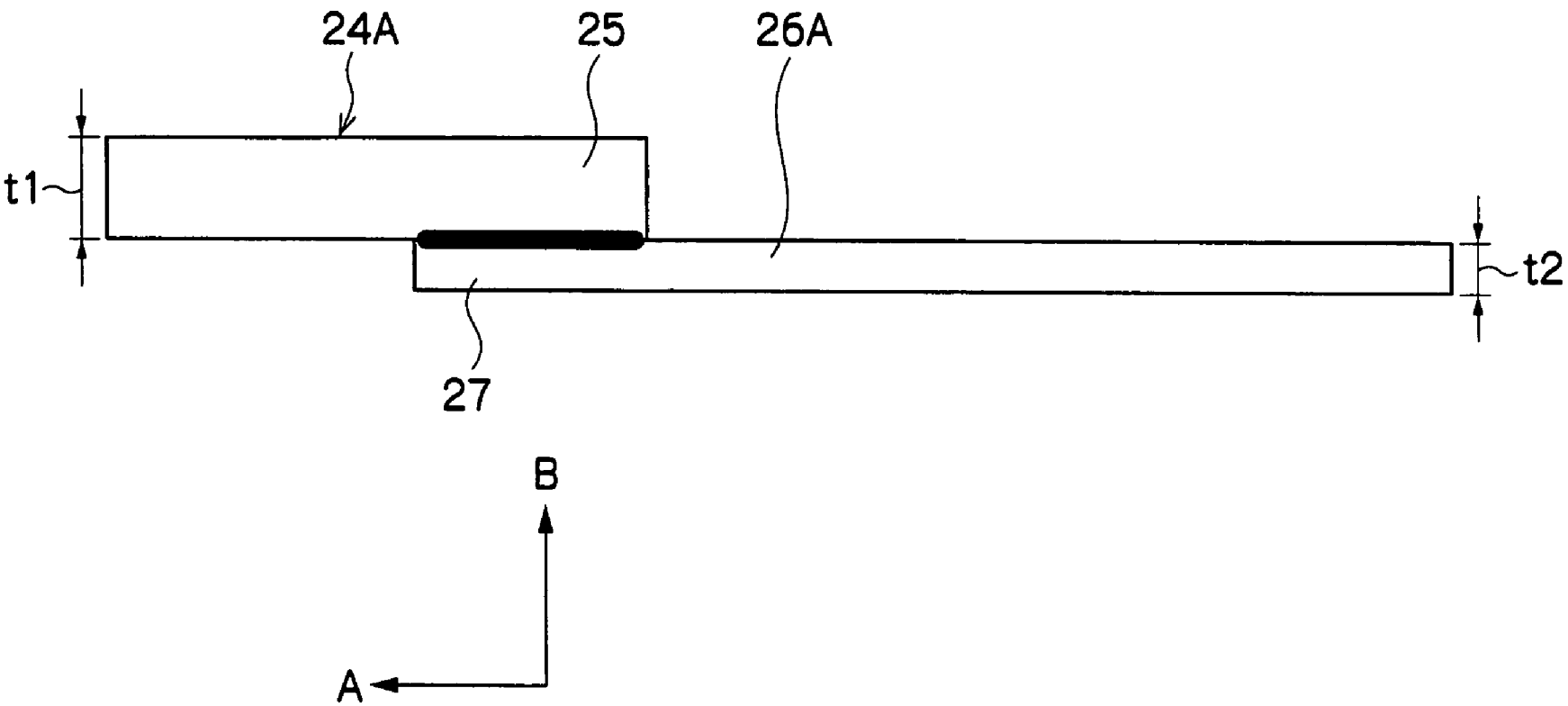
FIG. 5 is a plan view of a step in fabrication of the connector terminal, which shows an example of joining of the proximal end portion of the first wire member with the proximal end portion of the second wire member.

Next, as shown in FIG. 5, a welding process, such as, for example, a laser welding process or the like, is applied to the adjacent portions of the proximal end portion 25 of the first wire member 24A and the proximal end portion 27 of the second wire member 26A (herein, the portions which are tightly fitted or pressed against one another). Thus, the adjacent portions are joined.

Then, the first wire member 24A and second wire member 26A which have been joined in this manner, maintaining the mutually joined state thereof, are pushed into the upper tier terminal attachment hole 18 of the connector main body 14, from the distal end portion of the first wire member 24A (i.e., the end portion thereof at the side opposite from the second wire member 26A side thereof).

Then, the proximal end portion 25 of the first wire member 24A and the proximal end portion 27 of the second wire member 26A are together fitted to the upper tier terminal attachment hole 18 by a press-fitting process. When the press-fitting processing of the first wire member 24A and the second wire member 26A is completed, the first wire member 24A and the second wire member 26A are assembled to the upper tier terminal attachment hole 18, that is, to the connector main body 14. Hence, the first wire member 24A serves as the fitting portion 24.

Thereafter, of the second wire member 26A protruding outside (to rearward) of the connector main body 14, the proximal end portion 27 side (the fitting portion 24 side) is processed to be curved downward (toward the substrate 12) and the distal end portion side (the side thereof opposite from the fitting portion 24 side) is processed to be curved to lie along the upper face of the substrate 12. Hence, the second wire member 26A serves as the substrate attachment portion 26.

In the manner described above, the upper tier terminal 22 is fabricated.

Now, at the upper tier terminal 22 which has been fabricated as described above, a surface thereof is constituted by a plating layer at the peripheral surface of the first wire member 24A and a plating layer at the peripheral surface of the second wire member 26A. Therefore, a post-plating treatment need not be necessary.

Consequently, the process of fabrication of the upper tier terminal 22 of the present embodiment can suppress plating treatment costs, and hence fabrication costs, of the upper tier terminal 22, in comparison with an upper tier terminal fabrication process in which a post-plating treatment is applied.

Further, in this process for fabrication of the upper tier terminal 22, operations of, for example, applying press-machining to a plate-form strip member and forming workpieces in a complex shape linked in a comb-form subsequent to the press-machining (i.e., after punching of the plate material) are not necessary, and it is possible to fabricate the upper tier terminal 22 by the simple process of joining two wire members (the first wire member 24A and the second wire member 26A). Consequently, in comparison with an upper tier terminal fabrication process in which a workpiece with a complex shape is formed, material yield is improved.

Further still, the plating layer of the upper tier terminal 22 which is fabricated by this process for fabricating the upper tier terminal 22 is constituted by the plating layers which have been formed at the whole peripheral surfaces of the first wire member 24A and the second wire member 26A beforehand. Therefore, variations in plating thickness are small. As a result, the upper tier terminal 22 can be fabricated with high product quality.

Hereabove, the fabrication process of the upper tier terminal 22 has been described. A fabrication process of the lower tier terminal 28 is the same, except that the position at which the second wire member 26A that is the component of the substrate attachment portion 32 (which is the same as the second wire member 26A that is the component of the substrate attachment portion 26) is superposed relative to the first wire member 24A that is the component of the fitting portion 30 (which is the same as the first wire member 24A that is the component of the fitting portion 24) is mirrored between left and right in comparison with the above-described case of fabrication of the upper tier terminal 22. Accordingly, a description of the process for fabrication of the lower tier terminal 28 is omitted.

Furthermore, in the present embodiment, the thickness t2 of the second wire members 26A, which are both the components of the substrate attachment portions 26 of the upper tier terminals 22 and the components of the substrate attachment portions 32 of the lower tier terminals 28, is smaller than the thickness t1 of the first wire members 24A, which are both the components of the fitting portions 24 of the upper tier terminals 22 and the components of the fitting portions 30 of the lower tier terminals 28. Therefore, breadths of the fitting portions 24 of the upper tier terminals 22 are larger than breadths of the substrate attachment portions 26 of the same. As a consequence, even though the upper tier terminals 22 and the lower tier terminals 28 are assembled to the two upper and lower tiers of the connector main body 14 at coinciding positions in the left-right direction, the substrate attachment portions 26 of the upper tier terminals 22 and the substrate attachment portions 32 of the lower tier terminals 28 can be attached to the substrate 12 without interfering with one another. Therefore, there is no need, in order to avoid interference between the substrate attachment portions 26 and the substrate attachment portions 32, to fix the substrate attachment portions 26 and substrate attachment portions 32 to the substrate 12 with positions of attachment of the substrate attachment portions 26 to the substrate 12 being offset to rearward relative to positions of attachment of the substrate attachment portions 32 to the substrate 12 (i.e., to separate the positions of attachment of the substrate attachment portions 26 to the substrate 12 from the positions of attachment of the substrate attachment portions 32 to the substrate 12 in the front-rear direction). Thus, a region for attachment of the substrate attachment portions 26 and the substrate attachment portions 32 to the substrate 12, and hence a region for attachment of the SMT connector 10 to the substrate 12 (an area on the substrate 12), can be made smaller, which is advantageous.

Figure 6:
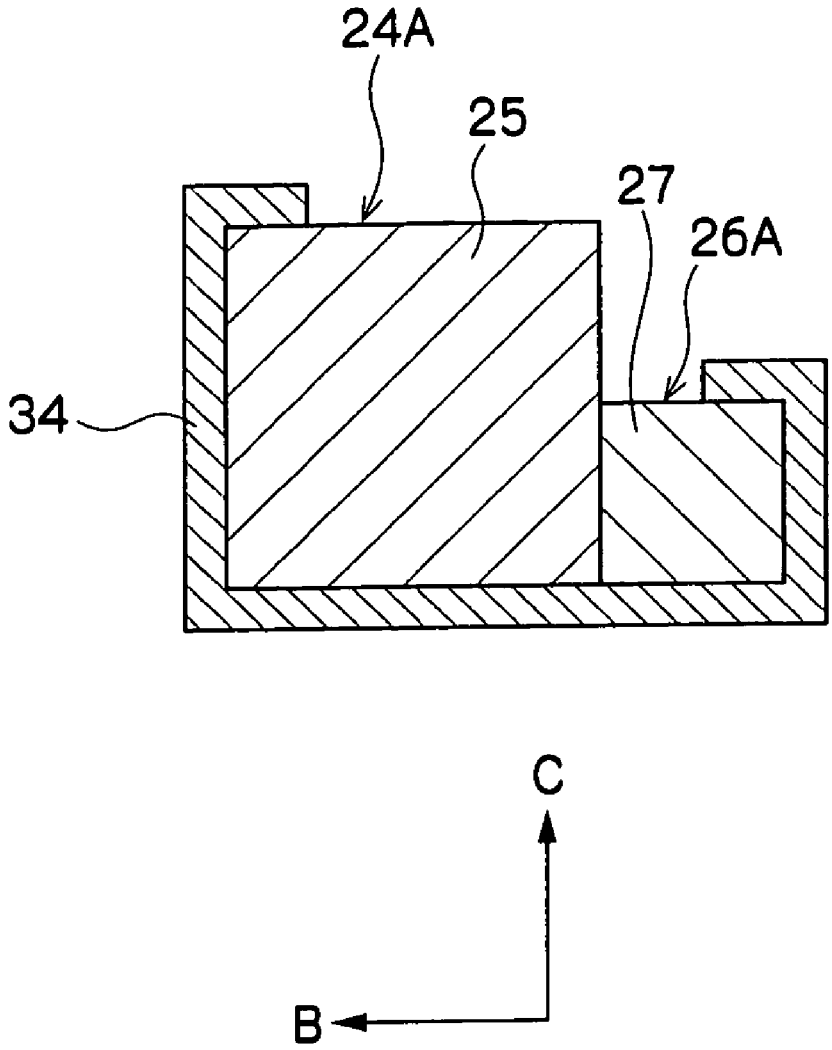
FIG. 6 is a sectional view showing another example of joining of the proximal end portion of the first wire member with the proximal end portion of the second wire member.

Anyway, in the present embodiment, when the proximal end portion 25 of the first wire member 24A is to be joined with the proximal end portion 27 of the second wire member 26A in a step of fabrication of the upper tier terminal 22 or the lower tier terminal 28, a welding treatment is applied, such as, for example, a laser welding process or the like. However, the present invention is not limited thus. For example, as shown in FIG. 6 (in which illustration the first wire member 24A and the second wire member 26A are shown in a step of fabrication of the upper tier terminal 22), when the proximal end portion 25 of the first wire member 24A and the proximal end portion 27 of the second wire member 26A are to be joined, a belt-like fastening member 34 (for example, a thin metal plate) may be wrapped by a bending process around the proximal end portion 25 of the first wire member 24A and the proximal end portion 27 of the second wire member 26A (excluding the region at which the proximal end portion 25 of the first wire member 24A and the proximal end portion 27 of the second wire member 26A are closely fitted to or pressed against one another). Thus, the proximal end portion 25 of the first wire member 24A and the proximal end portion 27 of the second wire member 26A are fastened. In this manner, the proximal end portion 25 of the first wire member 24A and the proximal end portion 27 of the second wire member 26A are joined.

What is claimed is:

1. A process for fabrication of a connector terminal to be assembled to a connector housing which is mounted on a substrate, the connector terminal including a fitting portion which fits with a connection terminal of a corresponding connector and a substrate attachment portion which is connected to the substrate, the connector terminal fabrication process comprising:

providing first and second wire members formed from solid metal, a thickness of said second wire member being less than a thickness of said first wire member;

plating the whole peripheral surfaces of said first and second wire members;

superposing respective end portions of said first wire member and said second wire member with one another and joining the end portions subsequent to said plating step;

forming the fitting portion from the first wire member, and forming the substrate attachment portion from the second wire member;

forming an attachment hole in the connector housing, and engaging the connector terminal including the fitting portion and the substrate attachment portion to the attachment hole, wherein a jointed superposed portion of the fitting portion and the substrate attachment portion is engaged to the attachment hole.

2. The connector terminal fabrication process of claim 1, wherein plural connector terminals are assembled to an upper tier and a lower tier in a direction perpendicular to the substrate, at the connector housing, and wherein a relative jointed position of the fitting portion and the substrate attachment portion of the connector terminal assembled to the upper tier and a relative jointed position of the fitting portion and the substrate attachment portion of the connector terminal assembled to the lower tier corresponding to the upper tier, are opposite.

3. The connector terminal fabrication process of claim 1, wherein the respective end portions of the first wire member and the second wire member are superposed with one another, and a superposed portion of the first wire member and the second wire member are wrapped by a fastening member to join the respective end portions of the first wire member and the second wire member.

4. The connector terminal fabrication process of claim 1, wherein both said first and second wire members have uniform cross sections along their respective lengths.

5. The connector terminal fabrication process of claim 1, wherein the connector terminal is assembled to the connector housing after superposing of the first wire member and the second wire member.

6. A connector terminal to be assembled to a connector housing which is mounted on a substrate, the connector terminal comprising: a fitting portion which fits with a connection terminal of a corresponding connector; and a substrate attachment portion which is connected to the substrate, wherein the fitting portion is formed from a first solid metal wire member, a whole peripheral surface of which includes a plating layer, and the substrate attachment portion is formed from a second solid metal wire member, a whole peripheral surface of which includes a plating layer, and wherein an end portion of the second wire member including the plating layer is superposed with and joined to an end portion of the first wire member including the plating layer, and a thickness of said second wire member being less than a thickness of said first wire member, wherein an attachment hole is formed in the connector housing, and the connector terminal including the fitting portion and the substrate attachment portion is engaged to the attachment hole, and wherein a jointed portion of the fitting portion and the substrate attachment portion is engaged to the attachment hole.

7. The connector terminal of claim 6, wherein plural connector terminals are assembled to an upper tier and a lower tier in a direction perpendicular to the substrate, at the connector housing, and wherein a relative jointed position of the fitting portion and the substrate attachment portion of the connector terminal assembled to the upper tier and a relative jointed position of the fitting portion and the substrate attachment portion of the connector terminal assembled to the lower tier corresponding to the upper tier, are opposite.

8. The connector terminal of claim 6, wherein the respective end portions of the first wire member and the second wire member are superposed with one another, and a superposed portion of the first wire member and the second wire member are wrapped by a fastening member to join the respective end portions of the first wire member and the second wire member.

9. The connector terminal of claim 6, wherein both said first and second wire members have uniform cross sections along their respective lengths.

10. The connector terminal of claim 6, wherein the connector terminal in which the first wire member and the second wire member are superposed is assembled to the connector housing.

* * * * *